US005404857A

United States Patent [19]

Schommers

[11] Patent Number: 5,404,857

[45] Date of Patent: Apr. 11, 1995

[54] METHOD FOR CONTROLLING A TWO-STROKE INTERNAL-COMBUSTION ENGINE

[75] Inventor: Joachim Schommers, Allmersbach, Germany

[73] Assignee: Mercedes-Benz AG, Germany

[21] Appl. No.: 143,193

[22] Filed: Oct. 29, 1993

[30] Foreign Application Priority Data

Oct. 29, 1992 [DE] Germany ..... 42 36 523.6

[51] Int. Cl.[6] ..... F02D 17/00

[52] U.S. Cl. ..... 123/481; 123/674; 123/198 DB; 123/73 C

[58] Field of Search ..... 123/198 DB, 674, 675, 123/435, 436, 481, 73 C

[56] References Cited

U.S. PATENT DOCUMENTS

| | | | |
|---|---|---|---|
| 4,366,794 | 1/1983 | Hachiga et al. | 123/198 DB |
| 4,391,255 | 7/1983 | Staerzi | 123/481 |
| 4,469,071 | 9/1984 | Bassi et al. | 123/481 |
| 4,509,488 | 4/1985 | Forster et al. | 123/481 |
| 4,530,332 | 7/1985 | Harvey et al. | 123/481 |
| 4,829,967 | 5/1989 | Nuti | 123/506 |
| 4,930,481 | 6/1990 | Fujimoto et al. | 123/198 DB |
| 4,962,740 | 10/1990 | Fujimoto et al. | 123/198 DB |
| 4,979,481 | 12/1990 | Shimomura et al. | 123/198 DB |
| 4,987,771 | 1/1991 | Iwata | 123/198 DB |
| 5,035,220 | 7/1991 | Uchinami et al. | 123/481 |
| 5,097,811 | 3/1992 | Baumuller | 123/73 C |
| 5,119,781 | 6/1992 | Trombley et al. | 123/481 |
| 5,213,081 | 5/1993 | Fujimoto | 123/481 |
| 5,263,453 | 11/1993 | Wakahara et al. | 123/481 |

FOREIGN PATENT DOCUMENTS

3735595A1 4/1988 Germany .

*Primary Examiner*—David A. Okonsky

*Attorney, Agent, or Firm*—Evenson, McKeown, Edwards & Lenahan

[57] ABSTRACT

The invention relates to a method for controlling a two-stroke internal-combustion engine with fuel injection in the low load range, in which the fuel supply to the combustion space is interrupted for a number of working strokes stored in a characteristic diagram which is a function of operating parameters. In this case, the stored characteristic diagram is adaptively corrected continuously by means of parameters which characterize the readiness to ignite or the ignition behavior of the internal-combustion engine.

6 Claims, 2 Drawing Sheets

METHOD FOR CONTROLLING A TWO-STROKE INTERNAL-COMBUSTION ENGINE

BACKGROUND AND SUMMARY OF THE INVENTION

This invention relates to a method for controlling a two-stroke internal-combustion engine with fuel injection in the low load range in which the supply of fuel to the combustion space is interrupted or released as a functional operating parameters.

A two-stroke internal-combustion engine with fuel injection is known from German Patent Document DE-OS 37 35 595 in which the supply of fuel to the combustion space in the partial-load range is permitted or prevented by a valve as a function of operating parameters.

In addition, a method for operating a two-stroke internal-combustion engine with an electronically controlled direct fuel injection is known from German Patent Document DE-OS 39 11 016, in which case the fuel injection during idling and in the low partial-load range takes place intermittently.

Finally, a method for interrupting the fuel supply is known from German Patent Document DE-PS 36 27 471. A characteristic diagram which is a function of operating parameters is used for this purpose, whereby an incomplete combustion is to be avoided of a cylinder filling which is not ignitable.

A disadvantage of the above-mentioned methods is that the interruption of the fuel supply is started for fixed specified operating conditions and is maintained in each case for a fixed specified period. In this case, it is not taken into account that the residual gas content in the combustion space which is decisive for the capability to ignite as well as the distribution of the residual gas in the combustion space may assume different values for each engine because of manufacturing tolerances, as well as that the residual gas content will change in the course of the engine operation, for example, as a result of deposits in the inlet and outlet, of wear-caused leakages in the inlet and outlet system, and of a wear-caused change of the friction device pressure. Finally, in the case of the known methods, the influence is also not taken into account which is exercised on the ignition reliability by the wear, the manufacturing tolerance and the contamination.

Although, in the case of the known methods, these unreliable factors can be offset to a certain degree by the fact that the number of working strokes without fuel injection is increased to such an extent that sufficient oxygen will be available in the combustion space under all operating conditions and thus the injected fuel is burnt reliably. However, under normal conditions, the ignition frequency of the engine and as a result the smooth running and the driving comfort would therefore be reduced. Inversely, the number of working strokes without fuel injection could be selected to be very low. However, the probability would then be increased that the injected fuel is not burnt which, in turn, would lead to an increase of the fuel consumption and a deterioration of the HC-emissions.

It is an object of the invention to provide a method for controlling two-stroke internal-combustion engines in the low load range in which the number of working strokes without fuel supply is continuously adapted to the actual condition of the engine so that an optimal compromise is achieved between a smooth running, the emissions and the fuel consumption.

According to the invention, this object is achieved by providing a method for controlling a two-stroke internal-combustion engine with fuel injection in the low load range, in which the supply of fuel to the combustion space is interrupted or released as a function of operating parameters, wherein for each injection operation, the number of working strokes ($f_{required}$) for which the fuel injection is to be interrupted is read out from a characteristic diagram (F) which is a function of operating parameters, the fuel supply is interrupted for ($f_{required}$) working strokes, after the ($f_{required}$) working strokes without fuel injection have been carried out, the capability of the working gas to ignite is checked, and the characteristic diagram (F) is adaptively corrected as a function of the capability of the working gas to ignite.

The method according to the invention has the advantage that the number of the working strokes at which the fuel supply is interrupted is adapted continuously. This means that the fuel supply is interrupted until the residual gas situated in the combustion space has been displaced by fresh air to such an extent that the injected fuel can actually be burnt. This avoids or at least reduces misfires and therefore improves the engine pollutant emission.

Further advantages and details of the method according to the invention are found in the subclaims and the specification.

Other objects, advantages and novel features of the present invention will become apparent from the following detailed description of the invention when considered in conjunction with the accompanying drawings.

DETAILED DESCRIPTION OF THE INVENTION

Figure 1:
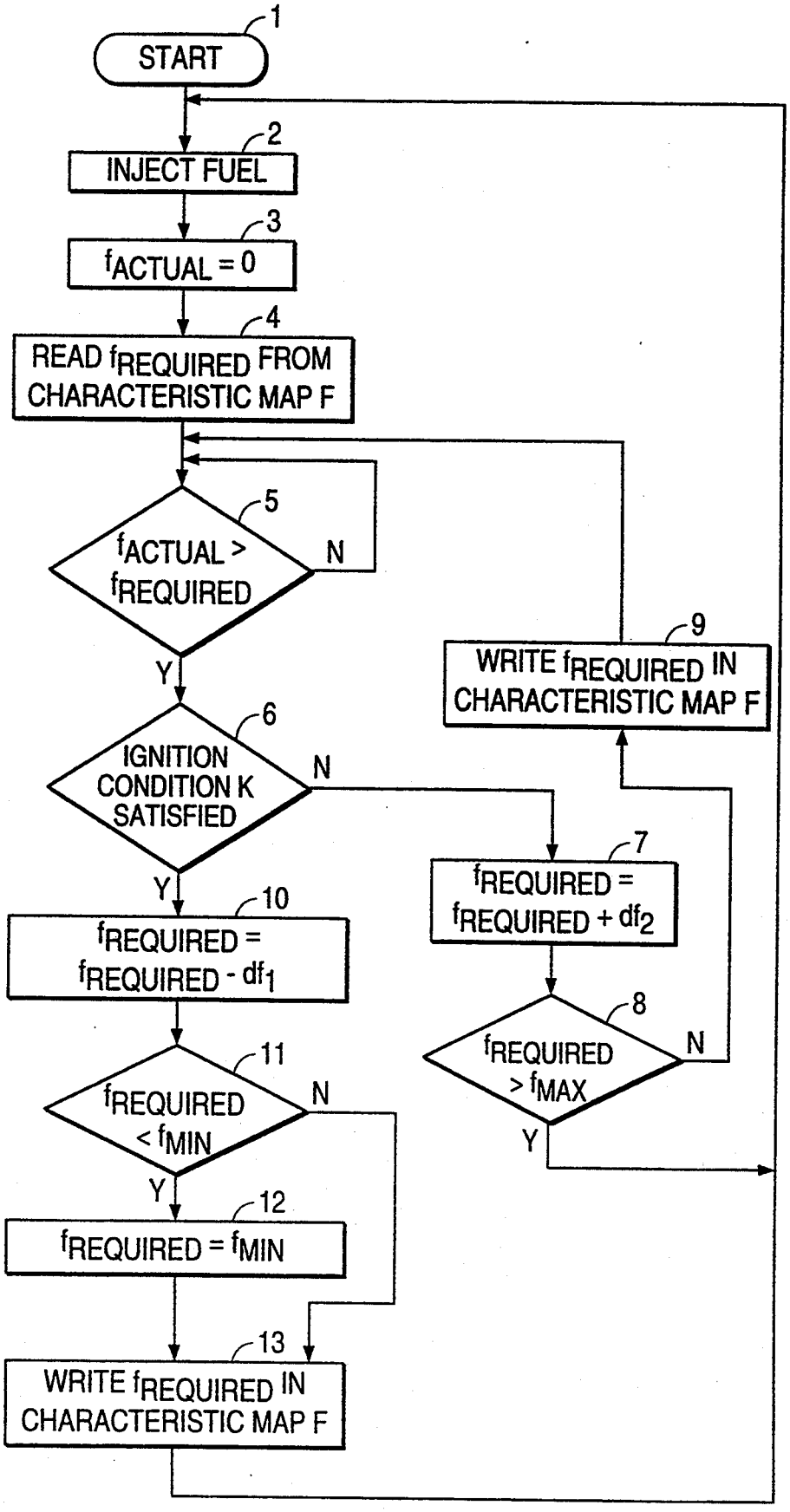
FIG. 1 is a flow diagram of a method according to the invention.

The method is provided for the operation of a two-stroke internal-combustion engine in the low load range, including during idling, and partially in overrun conditions, and relates primarily to quantity-controlled internal-combustion engines, that is, internal-combustion engines that are load-controlled by means of a throttle valve. However, in principle, a use in self-igniting internal-combustion engines is also possible. The applicable load range can be selected in that the number $f_{required}$ of the working strokes without fuel injection or fuel supply stored in characteristic diagram on map F is set to zero for the remaining operating range, thus the operating range situated outside the low load range. In the case of externally ignited internal-combustion engines, the ignition operation, that is, the ignition frequency and the ignition sequence, is not affected and will therefore not be described in detail in the following. The basic idea of the method illustrated in FIG. 1 is the fact that the next combustion operation is initiated at the earliest possible point in time. For this purpose, it is checked before each injection operation whether the combustion conditions in the combustion space, particularly the oxygen concentration, are so favorable that, after the injection of fuel, an externally ignited or self-ignited combustion can take place. If it is determined in this case that the working gas in the combustion space is not yet ignitable, the injection of the fuel is prevented and the checking of the capacity to ignite is repeated after a time period $df_2$.

The details of the sequence of the method are as follows:

After the start of the method illustrated in FIG. 1 in Block 1, the first fuel injection operation is started in Block 2, and the value for $f_{actual}$ is subsequently initialized in Block 3. In Block 4, the number of working strokes $f_{required}$, for which the fuel injection is to be interrupted, is then read out from a characteristic diagram F which is a function of operating parameters, and a checking takes place subsequently in Block 5 as to whether the specified number of working strokes $f_{required}$ has elapsed. If this is not the case, the process loops back to the beginning of Block 5 until the specified number of working strokes $f_{required}$ has elapsed.

The next Block 6 depicts examination of whether favorable conditions exist in the combustion space for the initiating of the ignition operation. The capability to ignite will exist when the conditions in the combustion space, for example, in regard to the quantity and distribution of fresh air, are such that after an injection and ignition a combustion would in fact take place. In this case, the checking may take place by comparing one or more operating parameters with specified threshold values. As an example, the oxygen concentration contained in the exhaust gas or in the working gas can be evaluated in which case the determination of the oxygen concentration may take place by means of a high-speed lambda probe. As a substitute, for determining the capability to ignite, the concentrations of combustion products in the exhaust gas, such as carbon monoxide, carbon dioxide, hydrocarbons, and oxides of nitrogen may also be used. In this case, the capability to ignite will exist when the concentrations of the combustion products fall below specified limit values.

As a function of the capability to ignite, the value $f_{required}$ stored in the characteristic diagram F will then be adaptively corrected. If the capability to ignite does not exist in Block 6, for example, when the oxygen concentration in the exhaust gas does not exceed a specified threshold value, the value $f_{required}$ stored in the characteristic diagram F is increased by a value $df_2$ in Block 7, and Block 8 will then check whether $f_{required}$ exceeds a specified maximum value $f_{max}$. If $f_{required}$ exceeds the maximum value $f_{max}$, the adaptation is interrupted and a jump takes place back to the beginning of Block 2 where the next combustion operation is made possible by the injection of fuel. If the adapted value $F_{required}$ does not exceed the maximum value $f_{max}$, it is stored in Block 9 in characteristic diagram F, and subsequently a jump takes place back to the beginning of Block 5. The process loops back to the beginning of Block 5 until the value $f_{actual}$ reaches the new required value $f_{required}$. This partial loop of the method will then be run through until either the maximum value $f_{max}$ is exceeded in Block 8, and the adaptation is therefore discontinued, or the capability to ignite is recognized in Block 6.

In the second case, that is, when the capability to ignite is recognized, the value for $f_{required}$ is reduced by a value $df_1$ in Block 10. In this case, the step widths $df_1$ and $df_2$ of the adaptation may have different values. Since, for reasons of plausibility, the value $f_{required}$ must not fall below a specified minimum value $f_{min}$, Block 11 will check this condition, and the value is, if necessary, fixed at $F_{required}=f_{min}$ in Block 12. The corrected value $f_{required}$ is subsequently taken over into the characteristic diagram F in Block 13 before the process jumps back to the beginning of Block 2 to continue the process.

The number $f_{required}$ of the working strokes without fuel injection is limited to a value between the limits $f_{min}$ and $f_{max}$ in order to ensure a proper operation of the internal-combustion engine also in the case of a faulty checking of the capability to ignite, for example, as the result of a defect in the sensory mechanism. The lower limit value is preferably fixed at $f_{min}=0$.

Figure 2:
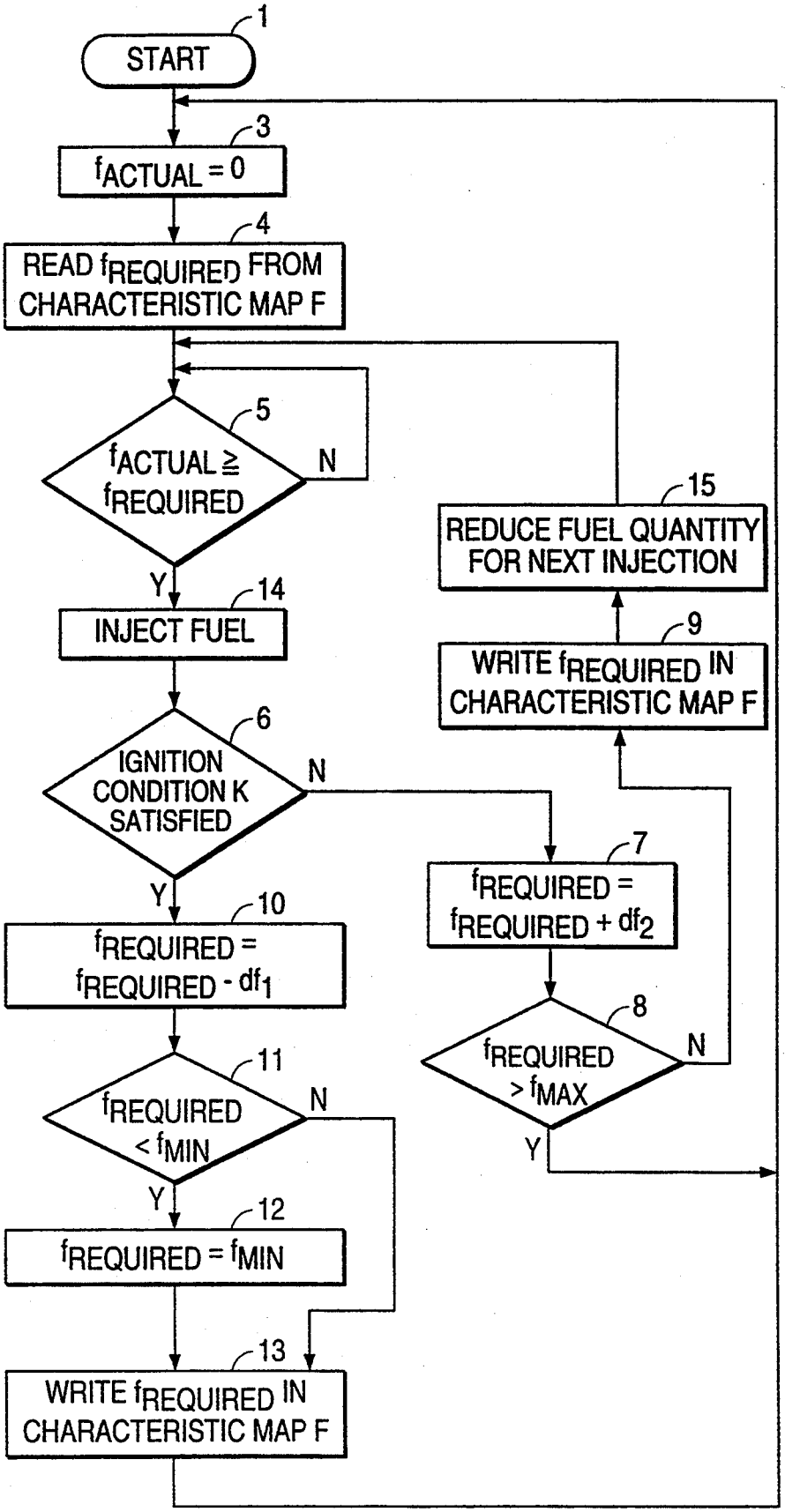
FIG. 2 is a flow diagram of another embodiment of the method according to the invention.

Injections without combustion can be avoided by means of the methods described above. In an alternative method, however, injections can also be permitted without or with incomplete combustion to a limited extent. This method is illustrated in FIG. 2, the same parts being characterized by the same reference symbols. This method is used when the sensory mechanism required for determining the capability to ignite of the working gas cannot be used. Here, the fuel is in each case injected after a number of extracted working cycles stored in a characteristic diagram. After the subsequent ignition, it is then checked whether a combustion has taken place. As long as in this case a proper combustion is recognized, the number of no-injection working strokes $f_{required}$ stored in the characteristic diagram is decremented. It is only after no combustion has taken place that the number $f_{required}$ is incremented again. Although, in the case of this method, in comparison to the first method, an increase of the HC-emissions is intentionally accepted, better emission values can nevertheless be achieved than with a misfire control without any adaptation.

In contrast to the method described above, Block 6 checks in this case whether, after the fuel injection in Block 14 and the subsequent ignition, a proper combustion has taken place, by the analysis of the rotational uniformity or by the evaluation of the signal of a combustion space pressure transducer. If a proper combustion has taken place, $f_{required}$ is reduced in steps in a manner analogous to the first method, in which case $f_{required}$ does not fall below the specified minimum values $f_{min}$. The step widths of the adaptation may likewise have different values, for example, $df_1=0.5$ and $df_2=3$. If, on the other hand, no combustion or only an incomplete combustion has taken place, $f_{required}$ is increased by a specified $df_2$ and the corrected value is included in the characteristic diagram F in order to increase the probability of combustion during the next injection. Since fuel is injected anew in Block 14 before the next checking of the ignition condition, a reduction of the fuel injection quantity takes place in Block 15 for the next injection operation.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method for controlling a two-stroke internal-combustion engine with fuel injection in the low load range, in which the supply of fuel to the combustion space is interrupted or released as a function of operating parameters, wherein for each injection operation, the number of working strokes ($f_{required}$) for which the fuel injection is to be interrupted is read out from a characteristic diagram (F) which is a function of operating parameters, the fuel supply is interrupted for said number of working strokes ($f_{required}$), after said number of working strokes without fuel injection have been carried out, the capability of the working gas to ignite is checked, and the characteristic diagram (F) is adaptively corrected as a function of the capability of the working gas to ignite.

2. A method according to claim 1, wherein the capability of the working gas to ignite is satisfied if the oxygen concentration measured in the exhaust gas flow of the internal-combustion engine exceeds a specified threshold value.

3. A method according to claim 1, wherein the capability of the working gas to ignite is satisfied if the concentration of one or more combustion products contained in the exhaust gas flow falls below specified threshold values.

4. A method for controlling a two-stroke internal-combustion engine with fuel injection in the low load range, in which the supply of fuel to the combustion space is interrupted or released as a function of operating parameters wherein for each injection operation, the number of working strokes ($f_{required}$) for which the fuel injection is to be interrupted is read out from the characteristic diagram (F) which is a function of operating parameters, after said number of working strokes ($f_{required}$) have been carried out, fuel is injected and it is then checked whether a combustion has taken place, and the characteristic diagram (F) is adaptively corrected as a function of the result of the checking of the combustion operation.

5. A method according to claim 4, wherein the checking of the combustion operation takes place by the analysis of a rotational uniformity and/or by the evaluation of a signal of a combustion space pressure transducer.

6. A method according to claim 4, wherein if it is recognized during the checking that no combustion has taken place, a reduced amount of fuel is injected during the next injection operation.

* * * * *